US012601094B2

(12) United States Patent
Fraser et al.

(10) Patent No.: US 12,601,094 B2
(45) Date of Patent: Apr. 14, 2026

(54) SEWING MACHINE ASSEMBLY

(71) Applicant: Gracewood Management, Inc., West Jordan, UT (US)

(72) Inventors: Craig Fraser, West Jordan, UT (US); Kyle Somer, West Jordan, UT (US); Sam Bagley, West Jordan, UT (US); Michael Campbell, West Jordan, UT (US)

(73) Assignee: GRACEWOOD MANAGEMENT, INC., West Jordan, UT (US)

( * ) Notice: Subject to any disclaimer, the term of this patent is extended or adjusted under 35 U.S.C. 154(b) by 0 days.

(21) Appl. No.: 18/909,286

(22) Filed: Oct. 8, 2024

(65) Prior Publication Data

US 2025/0116044 A1 Apr. 10, 2025

Related U.S. Application Data

(60) Provisional application No. 63/589,219, filed on Oct. 10, 2023.

(51) Int. Cl.
*D05B 29/06* (2006.01)
*D05B 27/04* (2006.01)

(52) U.S. Cl.
CPC ..... *D05B 29/06* (2013.01); *D05B 27/04* (2013.01)

(58) Field of Classification Search
CPC ..... D05B 29/02; D05B 29/08; D05B 29/12; D05B 29/04; D05B 29/06; D05B 29/00
USPC ..... 112/235, 240
See application file for complete search history.

(56) References Cited

U.S. PATENT DOCUMENTS

| | | | | | |
|---|---|---|---|---|---|
| 696,012 | A * | 3/1902 | Dimond et al. | D05B 29/06 | 112/235 |
| 2,611,333 | A * | 9/1952 | Ritter | D05B 29/08 | 112/235 |
| 3,372,660 | A * | 3/1968 | Bono | D05B 81/00 | 112/240 |
| 3,796,173 | A * | 3/1974 | Godsen | D05B 29/00 | 112/235 |
| 4,280,422 | A * | 7/1981 | Jung | D05B 35/02 | 112/153 |
| 4,646,668 | A * | 3/1987 | Biermann | D05B 29/08 | 112/311 |
| 5,676,075 | A * | 10/1997 | Chen | D05B 29/12 | 112/240 |
| 7,316,191 | B2 * | 1/2008 | Shomura | D05B 29/00 | 112/235 |
| 9,903,056 | B2 | 2/2018 | Koike et al. | | |
| 11,098,424 | B2 | 8/2021 | Azuma | | |
| 11,274,386 | B2 | 3/2022 | Takei | | |
| 11,377,767 | B2 | 7/2022 | Ishikawa et al. | | |
| 2023/0313429 | A1 * | 10/2023 | Mori | D05B 29/12 | 112/240 |

* cited by examiner

*Primary Examiner* — Danny Worrell
(74) *Attorney, Agent, or Firm* — Ryan L. Marshall; Jessica Kiser; Barnes & Thornburg LLP

(57) ABSTRACT

A sewing machine assembly includes a sewing machine frame, a main presser bar, and a presser foot assembly. The sewing machine frame includes a frame base, a frame body that extends from the frame base, a frame head coupled to the frame body that extends from the frame body toward the frame base. The main presser bar is mounted to the frame head of the sewing machine frame. The presser foot assembly includes an auxiliary presser bar offset from the main presser bar.

18 Claims, 11 Drawing Sheets

SEWING MACHINE ASSEMBLY

CROSS-REFERENCE TO RELATED APPLICATIONS

This application claims the benefit of U.S. Provisional Application No. 63/589,219, filed Oct. 10, 2023; the entire contents of this application is hereby incorporated by reference herein.

FIELD OF DISCLOSURE

The present disclosure relates generally to sewing or quilting machines, and more specifically to attachments for sewing or quilting machines.

BACKGROUND

Sewing machines are used for stitching one or more pieces of fabric with thread. Some sewing machines are stationary such that fabric is fed under a needle of the sewing machine, while other sewing machines, like quilting machines, are maneuverable such that the needle may be moved across the fabric.

Maneuverable sewing machines allow a user to create intricate patterns with the stitching. Such sewing or quilting machines, however, may also make it difficult to accurately follow a path on the fabric, such as a seam, a ditch line, or another desired pattern.

SUMMARY

The present disclosure may comprise one or more of the following features and combinations thereof.

A sewing machine assembly may include a sewing machine frame, a feed dog assembly, a main presser bar, and a presser foot assembly. The sewing machine frame may include a frame base, a frame body that extends from the frame base, a frame head coupled to the frame body that extends from the frame body toward the frame base to define a throat of the sewing machine frame. The feed dog assembly may include a feed dog mounted to the sewing machine frame to reciprocate horizontally relative to the sewing machine frame. The main presser bar may be mounted to the frame head that extends along a main axis from the frame head toward the frame base.

In some embodiments, the presser foot assembly may be configured to be changed between an unused configuration associated with a free motion mode of the sewing machine assembly and an in-use configuration associated with a fixed motion mode of the sewing machine assembly. In the unused configuration, the presser foot assembly may be spaced apart from the main presser bar. In the in-use configuration, the presser foot assembly may be coupled to the main presser bar.

In some embodiments, the presser foot assembly may include an auxiliary presser bar, a presser foot, and an auxiliary presser bar mount. The auxiliary presser bar may extend along an auxiliary axis between a first end and a second end spaced apart axially from the first end. The presser foot may be coupled to the first end of the auxiliary presser bar. The auxiliary presser bar mount may be coupled to the second end of the auxiliary presser bar.

In some embodiments, the auxiliary presser bar mount may be configured to be selectively coupled to the main presser bar to couple the presser foot assembly to the main presser bar in the in-use configuration. The auxiliary presser bar mount may be selectively coupled to the main presser bar to couple the presser foot assembly to the main presser bar in the in-use configuration so that the auxiliary axis of the auxiliary presser bar is offset from the main axis of the main presser bar to align the presser foot with the feed dog on the frame base.

In some embodiments, the auxiliary presser bar mount may include a mount body and a mount arm. The mount body may define a presser bar hole configured to receive the second end of the auxiliary presser bar. The mount arm may extend from the mount body toward the main presser bar at an angle relative to the mount body. The mount arm may define a presser bar groove configured to receive a terminal end of the main presser bar. In some embodiments, the angle of the mount arm relative to the mount body is about 90 degrees.

In some embodiments, the auxiliary presser bar mount may further include a fastener. The fastener may extend into the mount arm and the main presser bar to couple the presser foot assembly to the main presser bar.

In some embodiments, the presser foot assembly may further include a bias element. The bias element may be arranged in the presser bar hole to extend between the mount body of the auxiliary presser bar mount and the second end of the auxiliary presser bar to apply a bias force to the auxiliary presser bar to urge the presser foot toward the frame base of the sewing machine frame.

In some embodiments, the presser foot assembly may further include a bias element. The bias element may be arranged to extend between the auxiliary presser bar mount and the auxiliary presser bar to apply a bias force to the auxiliary presser bar to urge the presser foot toward the frame base of the sewing machine frame.

In some embodiments, the auxiliary presser bar may include a rod that extends along the auxiliary axis and a lip that extends radially outward from the rod around the rod. The bias element may extend around the rod and engages the lip to apply the bias force to the auxiliary presser bar.

In some embodiments, the main presser bar may have a first axial length and the auxiliary presser bar may have a second axial length. The second axial length may be less than the axial length of the main presser bar.

In some embodiments, the sewing machine assembly may further include a hopping foot. The hopping foot may be configured to be selectively coupled to a terminal end of the main presser bar in an in-use position when the presser bar assembly is in the unused configuration so that the sewing machine assembly is in the free motion mode.

According to another aspect of the present disclosure, a sewing machine assembly may include a sewing machine frame, a main presser bar, and an auxiliary presser bar. The sewing machine frame may include a frame base, a frame body that extends from the frame base, a frame head coupled to the frame body that extends from the frame body toward the frame base to define a throat of the sewing machine frame. The main presser bar may be mounted to the frame head of the sewing machine frame that extends vertically along a main axis from the frame head toward the frame base and configured to selectively couple to a hopping foot when the sewing machine assembly is in a free motion mode. The auxiliary presser bar may be mounted to the frame head of the sewing machine frame that extends vertically along an auxiliary axis that is parallel to the main axis and configured selectively couple to a presser foot when the sewing machine assembly is in a fixed motion mode. The auxiliary axis may be offset from the main axis.

In some embodiments, the auxiliary presser bar may be configured to be selectively coupled to the main presser bar. In some embodiments, the auxiliary presser bar may be mounted directly to the frame head of the sewing machine frame.

In some embodiments, the sewing machine assembly may further include an auxiliary presser bar mount. The auxiliary presser bar mount may be configured to selectively couple the auxiliary presser bar to the main presser bar.

In some embodiments, the auxiliary presser bar mount may include a mount body that defines a presser bar hole configured to receive one end of the auxiliary presser bar, a mount arm, and a fastener. The mount arm may extend from the mount body toward the main presser bar at an angle relative to the mount body and defines a presser bar groove configured to receive a terminal end of the main presser bar. The fastener may extend into the mount arm and the main presser bar to selectively couple the auxiliary presser bar to the main presser bar.

In some embodiments, the auxiliary presser bar mount may include a bias element. The bias element may be arranged in the presser bar hole to extend between the mount body of the auxiliary presser bar mount and the second end of the auxiliary presser bar to apply a bias force to the auxiliary presser bar to urge the presser foot toward the frame base of the sewing machine frame.

In some embodiments, the auxiliary presser bar mount may include a bias element. The bias element may be arranged to extend between the frame head and the auxiliary presser bar to apply a bias force to the auxiliary presser bar to urge the presser foot toward the frame base of the sewing machine frame.

In some embodiments, the auxiliary presser bar may include a rod that extends along the auxiliary axis and a lip that extends radially outward from the rod around the rod. The bias element may extend around the rod and engages the lip to apply the bias force to the auxiliary presser bar.

In some embodiments, the sewing machine assembly may further include a bias element. The bias element may be arranged to apply a bias force to the auxiliary presser bar to urge the presser foot toward the frame base of the sewing machine frame.

According to another aspect of the present disclosure, a sewing machine assembly may include a sewing machine frame, a feed dog assembly, a main presser bar, and a presser foot assembly. The sewing machine frame may include a frame base, a frame body that extends from the frame base, a frame head coupled to the frame body that extends from the frame body toward the frame base to define a throat of the sewing machine frame. The feed dog assembly may include a feed dog mounted to the sewing machine frame to reciprocate horizontally relative to the sewing machine frame. The main presser bar may be mounted to the frame head that extends along a main axis from the frame head toward the frame base.

In some embodiments, the presser foot assembly may be configured to be changed between an unused configuration associated with a free motion mode of the sewing machine assembly and an in-use configuration associated with a fixed motion mode of the sewing machine assembly. In the unused configuration, the presser foot assembly may be spaced apart from the main presser bar. In the in-use configuration, the presser foot assembly may be coupled to the main presser bar.

In some embodiments, the presser foot assembly may include an auxiliary presser bar, a presser foot, and an auxiliary presser bar mount. The auxiliary presser bar may extend along an auxiliary axis between a first end and a second end spaced apart axially from the first end. The presser foot may be coupled to the first end of the auxiliary presser bar. The auxiliary presser bar mount may be coupled to the second end of the auxiliary presser bar. The auxiliary presser bar mount may be configured to be selectively mounted to the frame head of the sewing machine frame to couple the presser foot assembly to the sewing machine frame in the in-use configuration so that the auxiliary axis of the auxiliary presser bar is offset from the main axis of the main presser bar to align the presser foot with the feed dog on the frame base.

These and other features of the present disclosure will become more apparent from the following description of the illustrative embodiments.

DETAILED DESCRIPTION OF THE DRAWINGS

Figure 1:
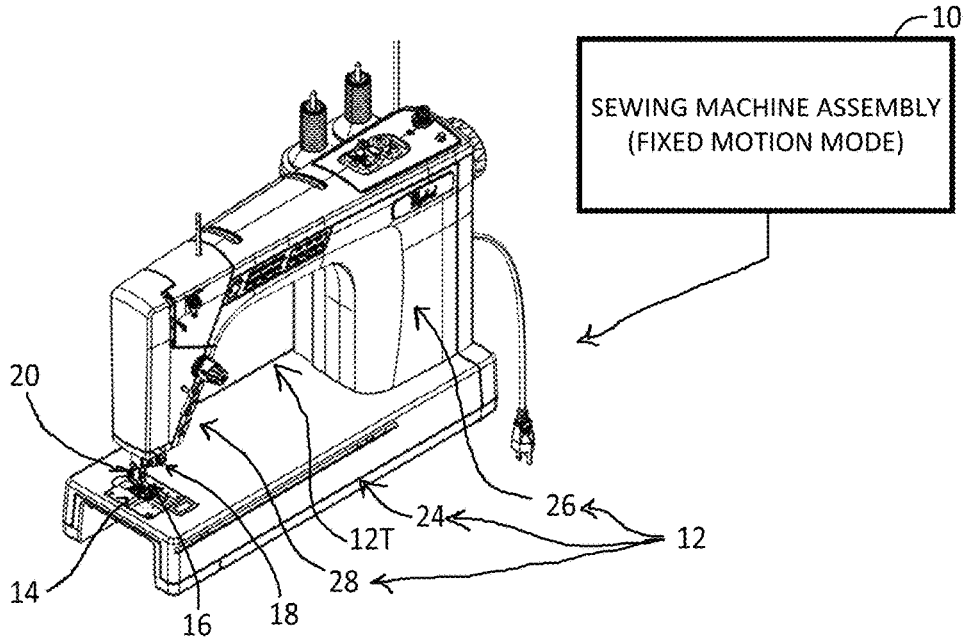
FIG. 1 is a perspective view of a sewing machine assembly in a fixed motion mode.

For the purposes of promoting an understanding of the principles of the disclosure, reference will now be made to a number of illustrative embodiments illustrated in the drawings and specific language will be used to describe the same.

Figure 2:
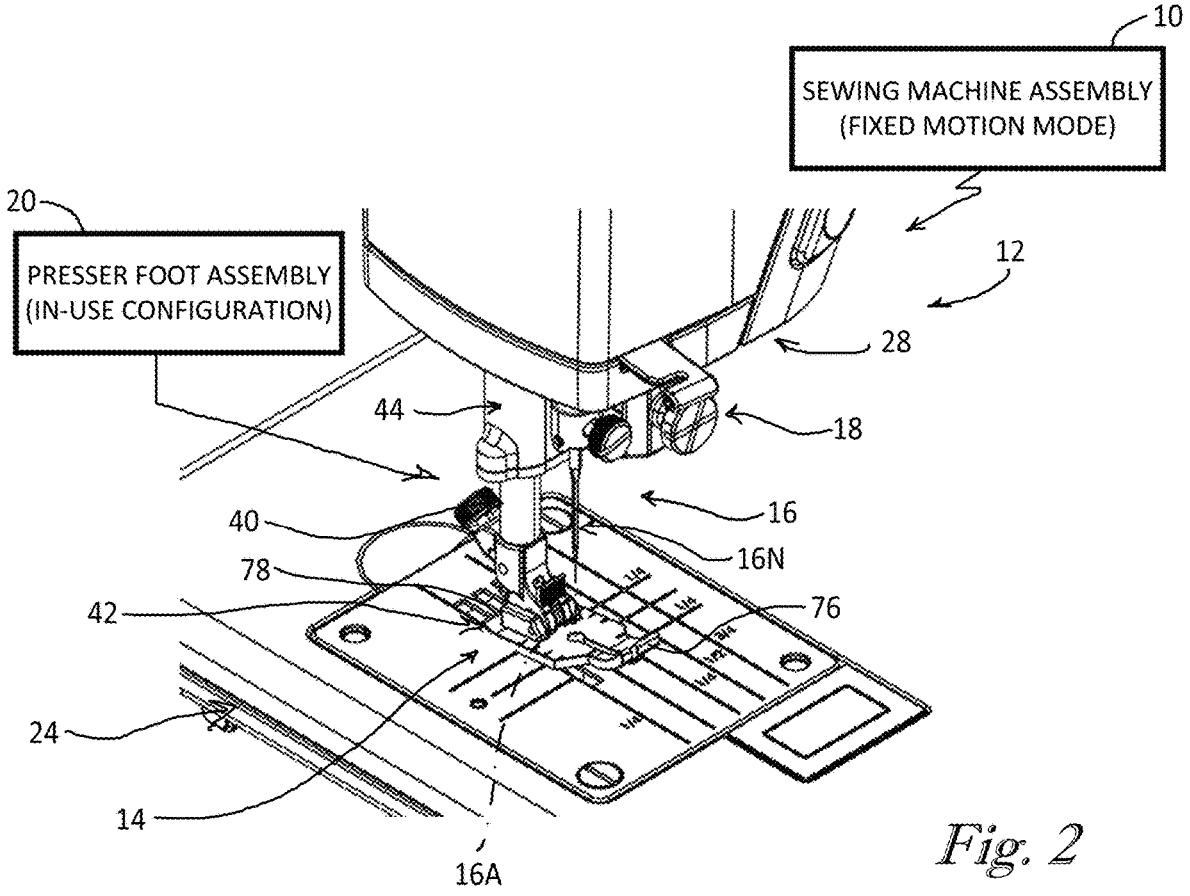
FIG. 2 is a detail view of FIG. 1 showing the sewing machine assembly includes a sewing machine frame with a sewing frame head, a main presser bar mounted to the frame head that extends along a main axis, and a presser foot assembly configured to change between an unused configuration associated with a free motion mode of the sewing machine assembly shown in FIG. 8 and an in-use configuration associated with a fixed motion mode of the sewing machine assembly in which the presser foot assembly is coupled to the main presser bar.
Figure 9:
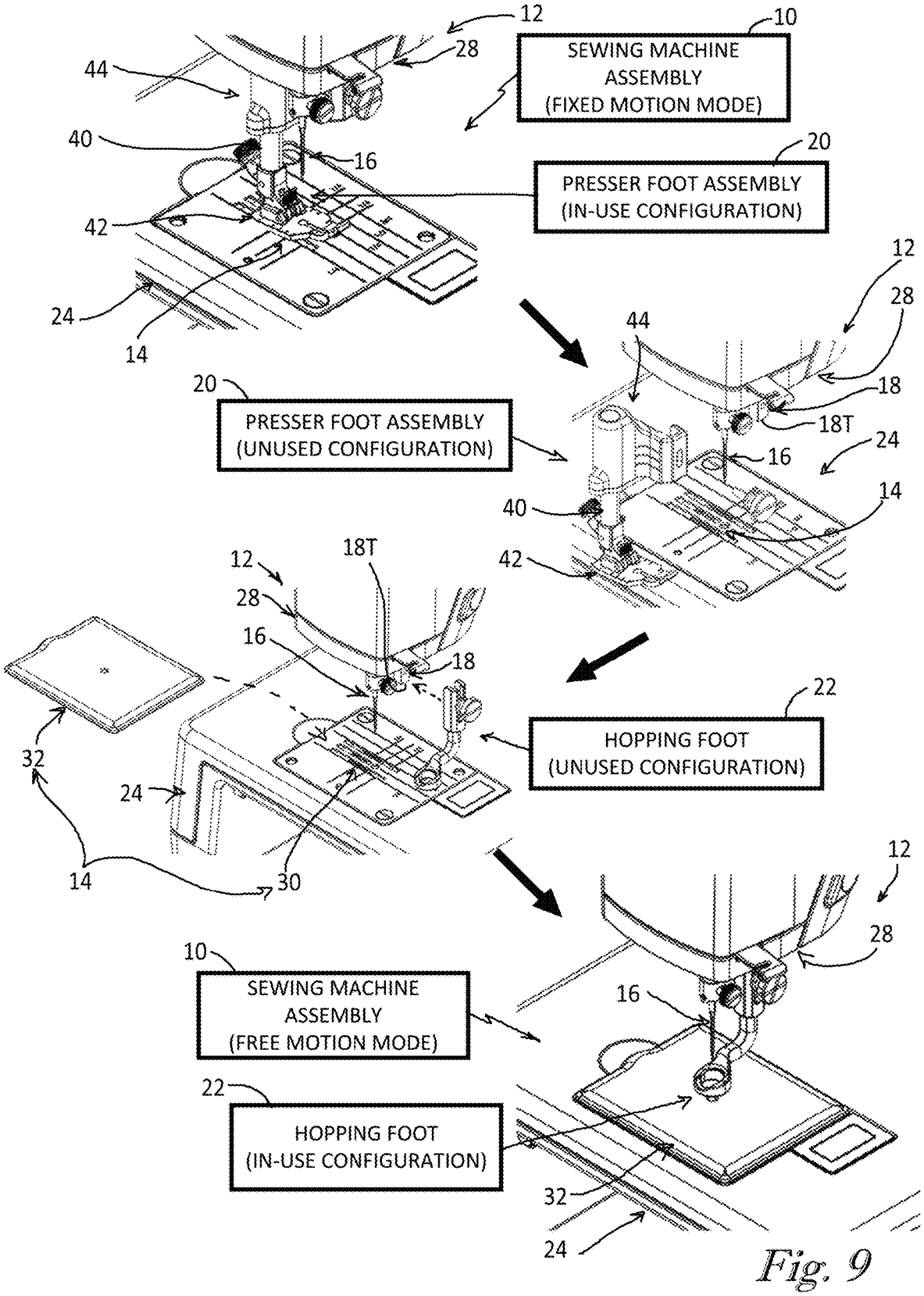
FIG. 9 is a diagrammatic view of the sewing machine assembly of FIG. 1 showing the process of changing the sewing machine assembly from the fixed motion mode to the free motion mode by changing the presser foot assembly from the in-use configuration to the unused configuration so that the hopping foot may be coupled to the main presser bar.
Figure 10:
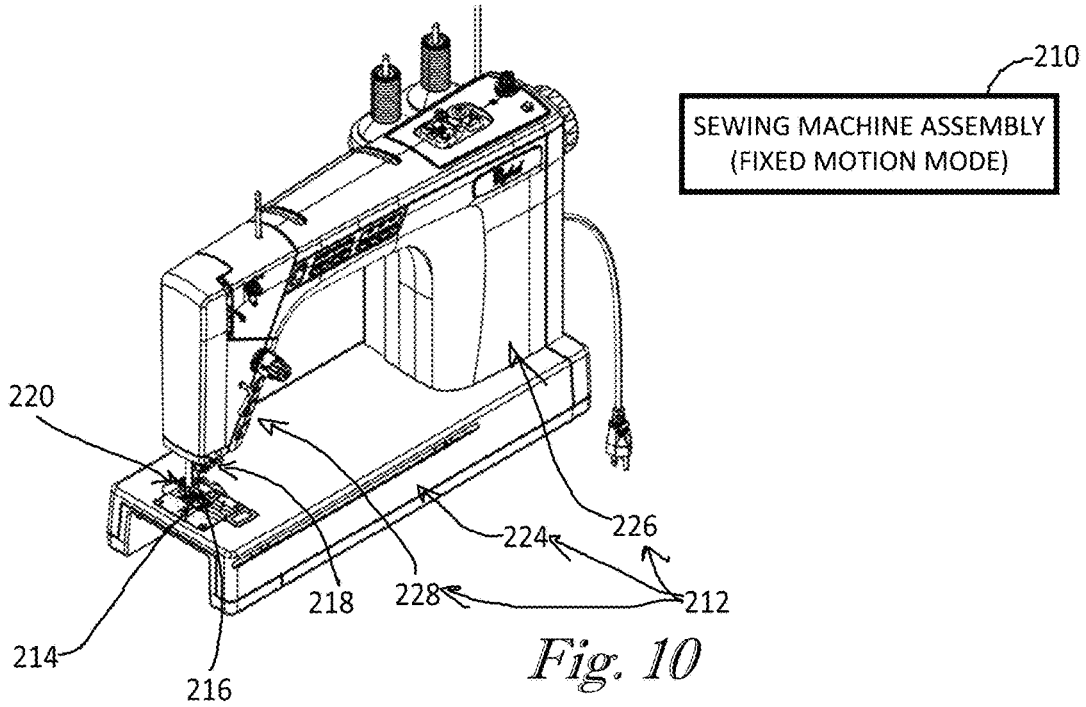
FIG. 10 is a perspective view of another embodiment of a sewing machine assembly in a fixed motion mode.
Figure 11:
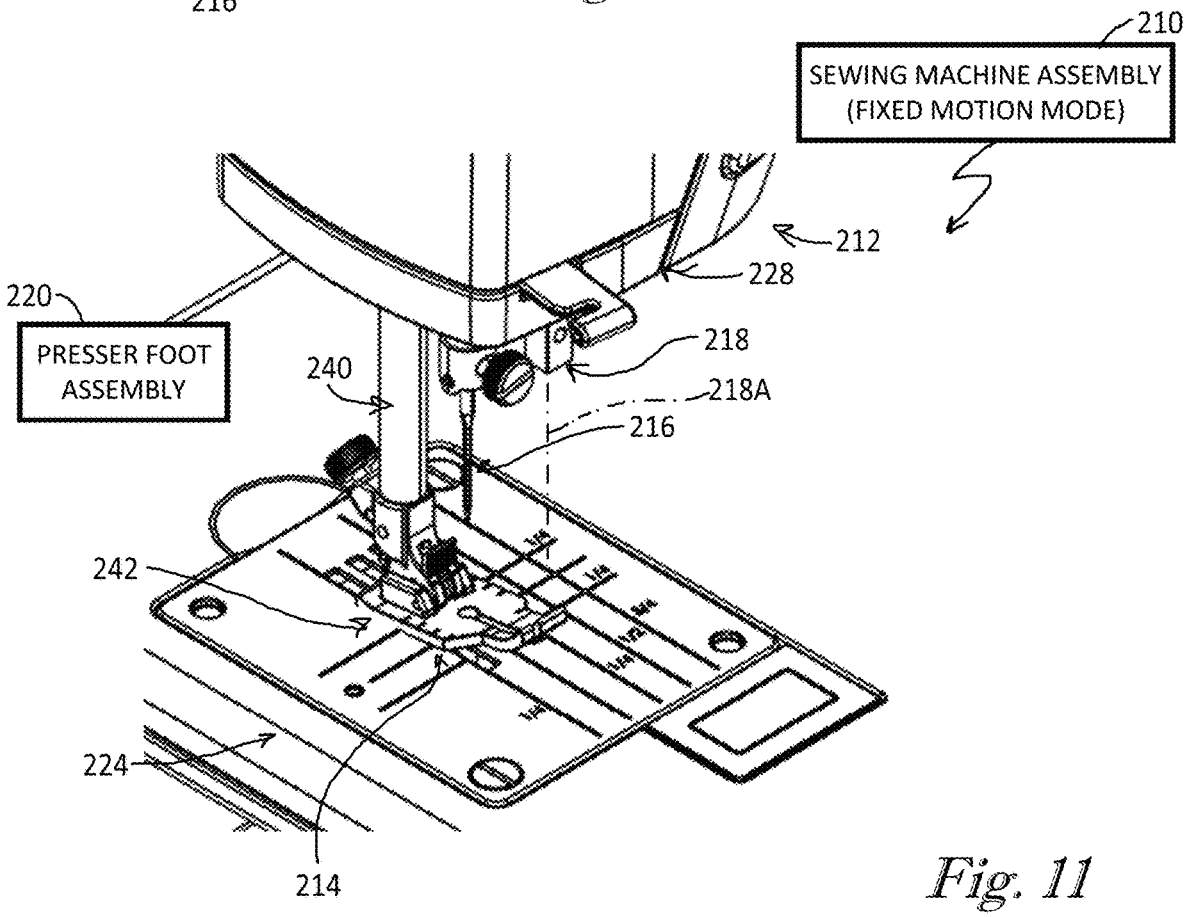
FIG. 11 is a detail view of FIG. 10 showing the sewing machine assembly includes a sewing machine frame with a sewing frame head, a main presser bar mounted to the frame head that extends along a main axis, and a presser foot assembly mounted directly to a frame head of the sewing machine assembly.

An illustrative embodiment of a sewing machine assembly 10 is shown in FIGS. 1 and 2. The sewing machine assembly 10 is configured change between a fixed motion mode as shown in FIG. 2 and a free motion mode as shown in FIG. 9.

In the free motion mode, a user is able to freely maneuver the sewing machine assembly in lateral and longitudinal directions. The fabric remains in place, while the sewing machine is moved relative to the fabric to sew the fabric. This allows the user to create intricate patterns with the stitching.

In the fixed motion mode, the sewing machine is fixed in place and the fabric is feed through the sewing machine to sew the fabric. In the fixed motion mode, a feed dog assembly may be used to pull the fabric through the sewing machine.

Typically, a sewing machine is only operable in one of the free motion mode or the fixed motion mode. The user would then need to switch between different machines depending on the desired stitching.

Therefore, the sewing machine assembly 10 is convertible between the free motion mode and the fixed motion mode as shown in FIG. 9. The sewing machine assembly 10 includes a feed dog assembly 14 that includes a feed dog mounted to the sewing machine frame 12 to reciprocate horizontally relative to the sewing machine frame 12 to pull the fabric therethrough when the sewing machine assembly 10 is in the fixed motion mode.

However, a hopping foot is commonly used in the free motion mode, while a presser or walking foot is used in the fixed motion mode. The hooping foot may provide a substantially unobstructed view of the fabric compared to the presser foot when the user desires to create intricate patterns with the stitching. Additionally, the presser foot may need to align with the feed dog as the feed dog and presser foot work together to pull the fabric through the sewing machine.

The sewing machine assembly 10 has a sewing machine frame 12, a feed dog assembly 14, a needle bar 16, a main presser bar 18, and a presser foot assembly 20 that allows the user to switch between a hopping foot and a presser foot as shown in FIGS. 1-9. The feed dog assembly 14 has the feed dog 30 mounted to the sewing machine frame 12 to reciprocate horizontally relative to the sewing machine frame 12. The needle bar 16 is attached to a frame head 28 of the sewing machine frame 12 and configured to linearly reciprocate relative to the frame head 28 along a needle bar axis 16A. The main presser bar 18 is attached to the frame head 28 of the sewing machine frame 12 and extends toward a frame base 24 along a main axis 18A.

Figure 8:
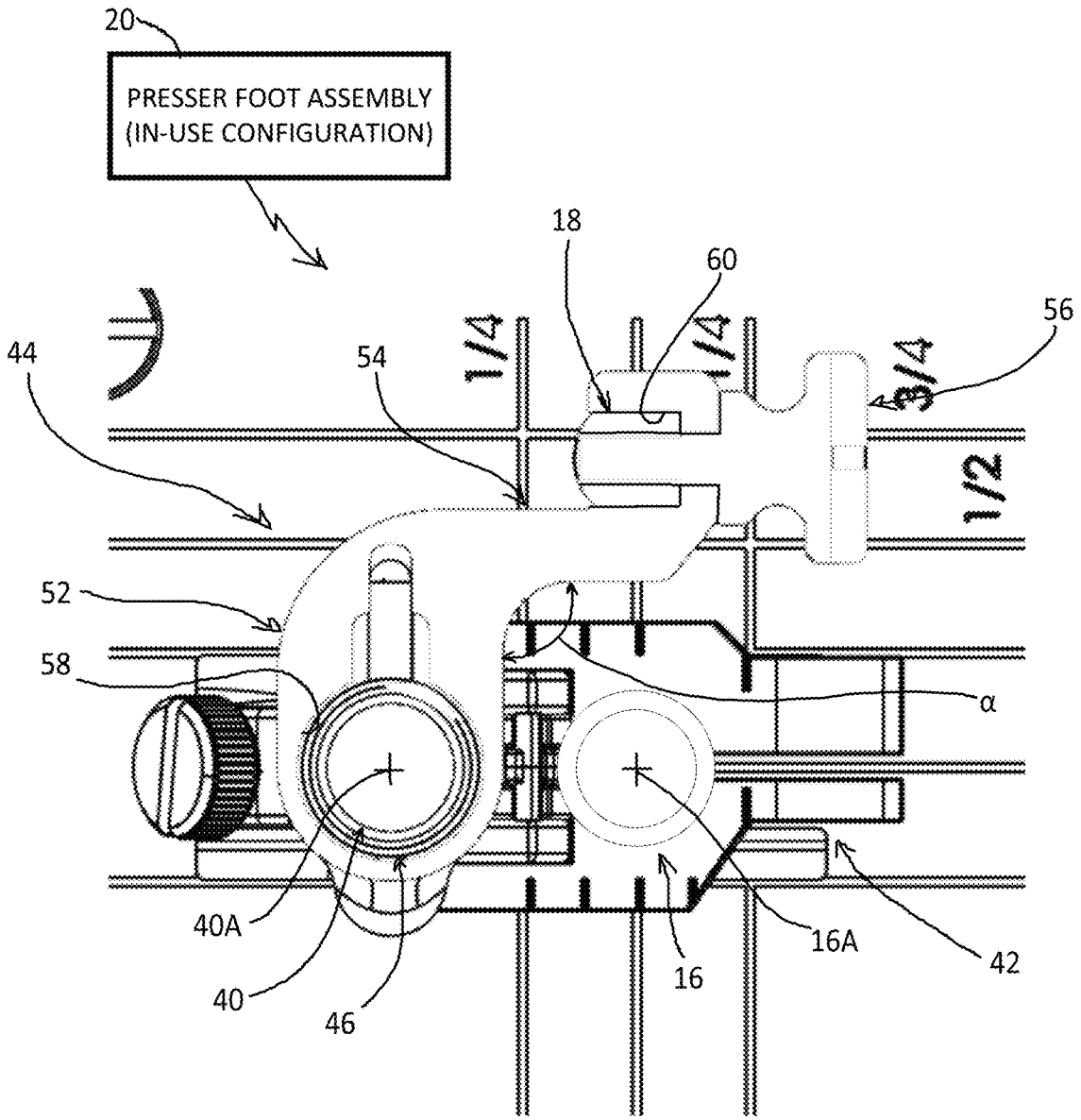
FIG. 8 is a cross-section view of the sewing machine assembly of FIG. 1 showing the mount arm of the auxiliary presser bar mount is angled relative to the mount body so that the auxiliary presser bar mount wraps around the needle bar.

The presser foot assembly 20 is configured to be changed between an unused configuration associated with the free motion mode of the sewing machine assembly as shown in FIG. 8 and an in-use configuration associated with the fixed motion mode of the sewing machine assembly as shown in FIG. 2. In the unused configuration, the presser foot assembly 20 is spaced apart from the main presser bar 18. In the in-use configuration, the presser foot assembly 20 is coupled to the main presser bar 18. This allows the user to go back and forth between the free motion mode and the fixed motion mode.

The presser foot assembly 20 includes an auxiliary presser bar 40, a presser foot 42, and an auxiliary presser bar mount 44 as shown in FIGS. 2-9. The auxiliary presser bar 40 extends along an auxiliary axis 40A between a first end 48 and a second end 50 spaced apart axially from the first end 48. The presser foot 42 is coupled to the first end 48 of the auxiliary presser bar 40. The auxiliary presser bar mount 44 is coupled to the second end 50 of the auxiliary presser bar 40.

The auxiliary presser bar mount 44 is configured to be selectively coupled to the main presser bar 18 as shown in FIG. 9. The auxiliary presser bar mount 44 selectively couples to the main presser bar 18 to couple the presser foot assembly 20 to the main presser bar 18 in the in-use configuration to align the presser foot 42 with the feed dog.

The auxiliary presser bar mount 44 offsets the auxiliary presser bar 40 from the main presser bar 18 to align the presser foot 42 with the feed dog on the frame base 24.

Turning again to the sewing machine frame 12, the sewing machine frame 12 includes the frame base 24, a frame body 26, and the frame head 28 as shown in FIG. 1. The frame body 26 extends from the frame base 24. The frame head 28 is coupled to the frame body 26 and extends from the frame body 26 toward the frame base 24 to define a throat 12T of the sewing machine frame 12.

The feed dog assembly 14 is located in the frame base 24 of the sewing machine frame 12 as shown in FIGS. 1 and 9. The feed dog assembly 14 includes the feed dog 30, a feed dog drive system (not shown), and a feed dog cover 32. The feed dog drive system is configured to drive reciprocating movement of the feed dog 30 relative to the frame base 24. The feed dog cover 32 is configured to be selectively coupled to the frame base 24 to change the sewing machine assembly 10 between the free and fixed motion modes.

The needle bar 16 is attached to the frame head 28 of the sewing machine frame 12 as shown in FIGS. 2 and 5-7. The needle bar 16 is configured to linearly reciprocate relative to the frame head 28 along a needle bar axis 16A. A needle 16N is coupled to the needle bar 16.

The main presser bar 18 is mounted to the frame head 28 as shown in FIGS. 2 and 5-7. The main presser bar 18 extends from the frame head 28 toward the frame base 24. In the illustrative embodiment, a hopping foot 22 is configured to be selectively coupled to a terminal end 18T of the main presser bar 18 in an in-use position when the presser bar assembly is in the unused configuration so that the sewing machine assembly is in the free motion mode.

The presser foot assembly 20 includes the auxiliary presser bar 40, the presser foot 42, the auxiliary presser bar mount 44, and a bias element 46 as shown in FIGS. 2-9. The bias element 46 is arranged in a presser bar hole 58 formed in the auxiliary presser bar mount 44. The bias element 46 is arranged in the presser bar hole 58 to extend between the auxiliary presser bar mount 44 and the second end 50 of the auxiliary presser bar 40 to apply a bias force to the auxiliary presser bar 40 to urge the presser foot 42 toward the frame base 24 of the sewing machine frame 12.

The auxiliary presser bar mount 44 includes a mount body 52, a mount arm 54, and a fastener 56 as shown in FIGS. 3-8. The mount body 52 defines the presser bar hole 58 configured to receive the second end 50 of the auxiliary presser bar 40. The mount arm 54 extends from the mount body 52 toward the main presser bar 18 at an angle $\alpha$ relative to the mount body 52. The mount arm 54 defines a presser bar groove 60 configured to receive the terminal end 18T of the main presser bar 18. The fastener 56 extends into the mount arm 54 and the main presser bar 18 to couple the presser foot assembly 20 to the main presser bar 18.

In the illustrative embodiment, the angle $\alpha$ of the mount arm 54 relative to the mount body 52 corresponds to the offset of the feed dog 30 relative to the main presser bar 18. The angle $\alpha$ of the mount arm 54 relative to the mount body 52 is about 90 degrees in the illustrative embodiment.

Figure 3:
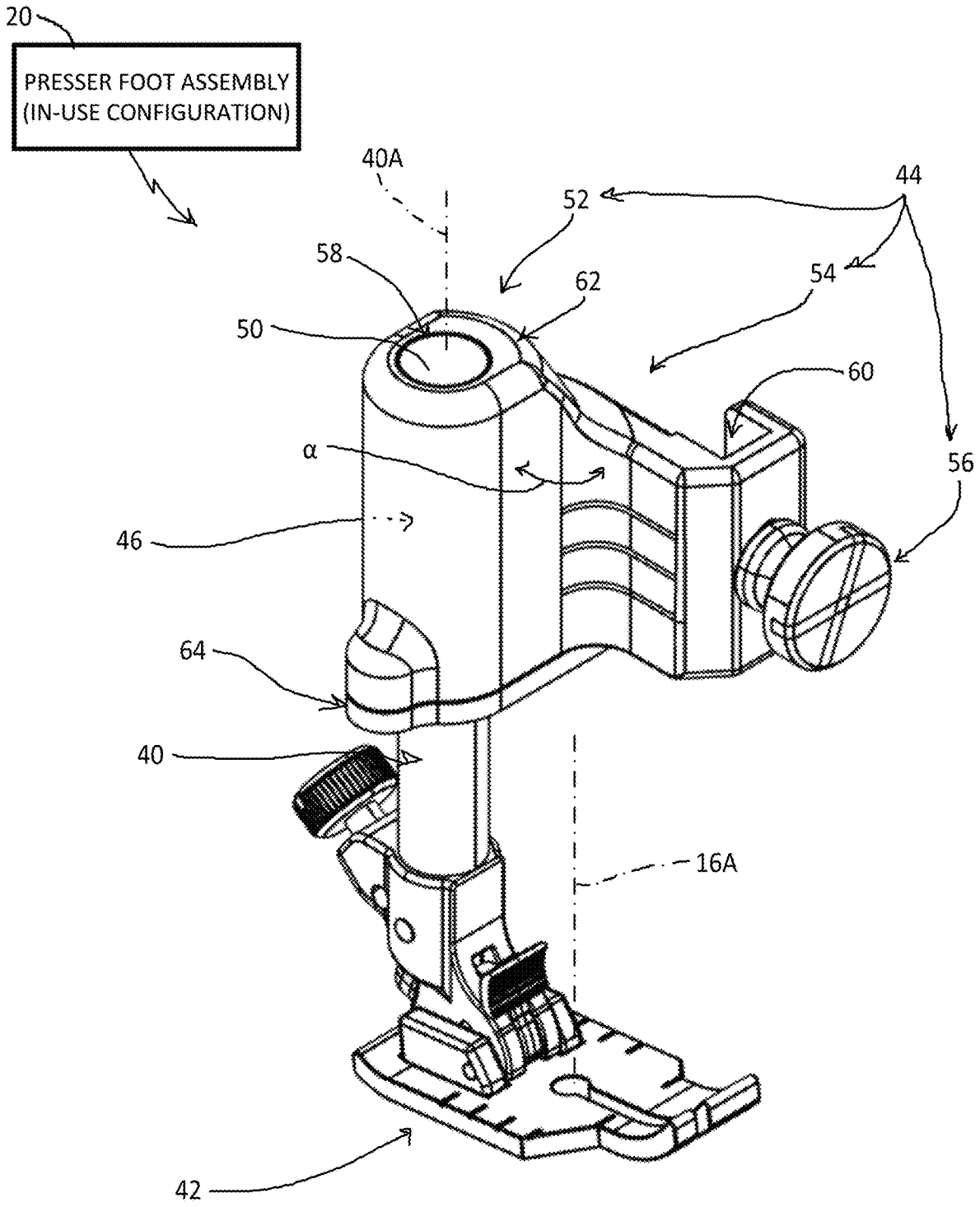
FIG. 3 is a perspective view of the presser foot assembly included in the sewing machine assembly of FIG. 2 showing the presser foot assembly includes an auxiliary presser bar that extends along an auxiliary axis, a presser foot coupled to a first end of the auxiliary presser bar, and an auxiliary presser bar mount coupled to a second end of the auxiliary presser bar that is selectively coupled to the main presser bar to couple the presser foot assembly to the main presser bar in the in-use configuration so that the auxiliary axis of the auxiliary presser bar is offset from the main axis of the main presser bar to align the presser foot with a feed dog on a frame base of the sewing machine frame, and further showing the auxiliary presser bar mount includes a mount body that defines a presser bar configured to receive one end of the auxiliary presser bar, a mount arm extends from the mount body toward the main presser bar at an angle relative to the mount body, and a fastener is configured to extend into the mount arm and the main presser bar to couple the presser foot assembly to the main presser bar.
Figure 4:
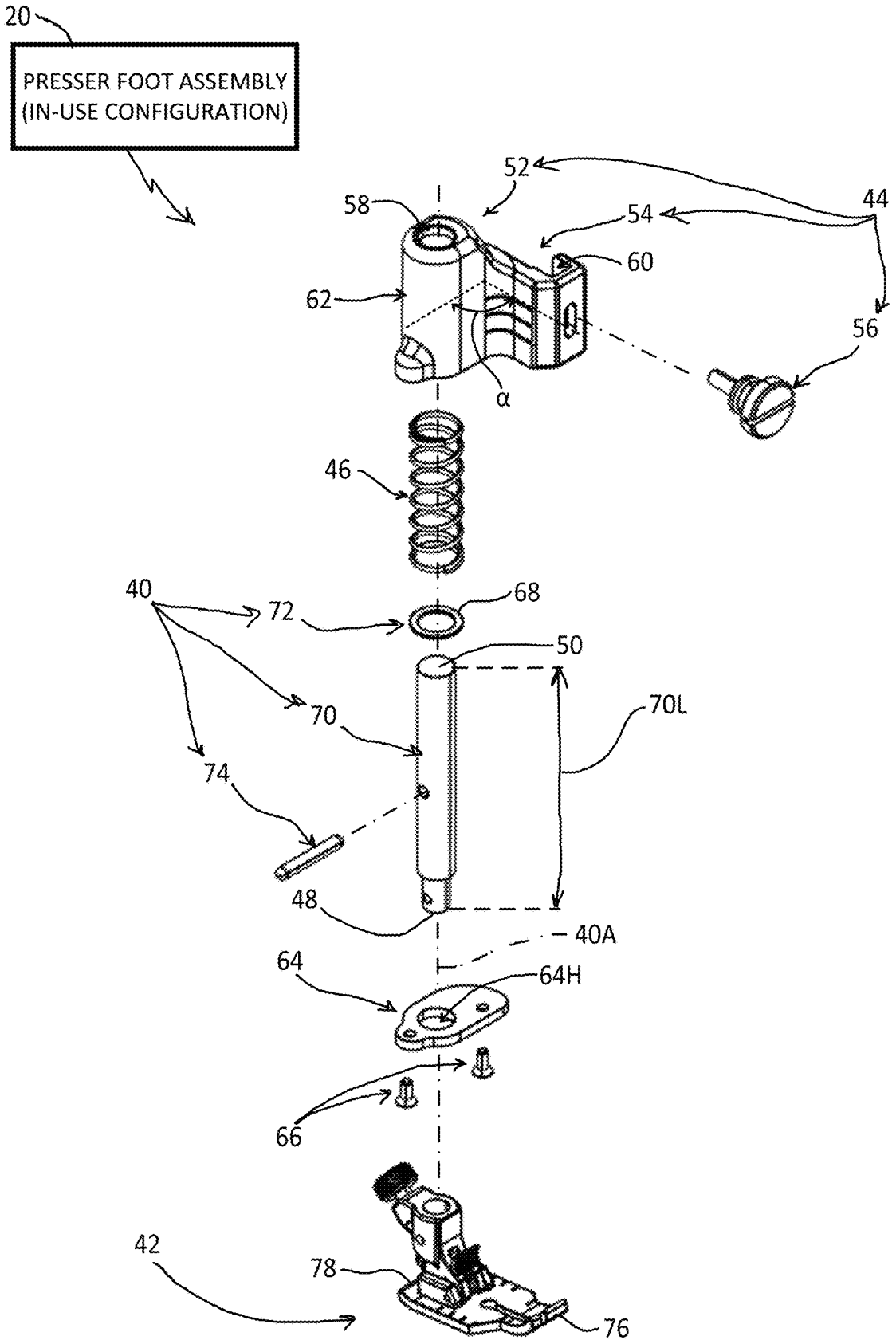
FIG. 4 is an exploded view of the presser foot assembly of FIG. 3 showing the auxiliary presser bar mount further includes a bias member configured to be arranged between the auxiliary presser bar and the auxiliary presser bar mount to apply a bias force to the auxiliary presser bar to urge the presser foot toward the frame base of the sewing machine frame.
Figure 5:
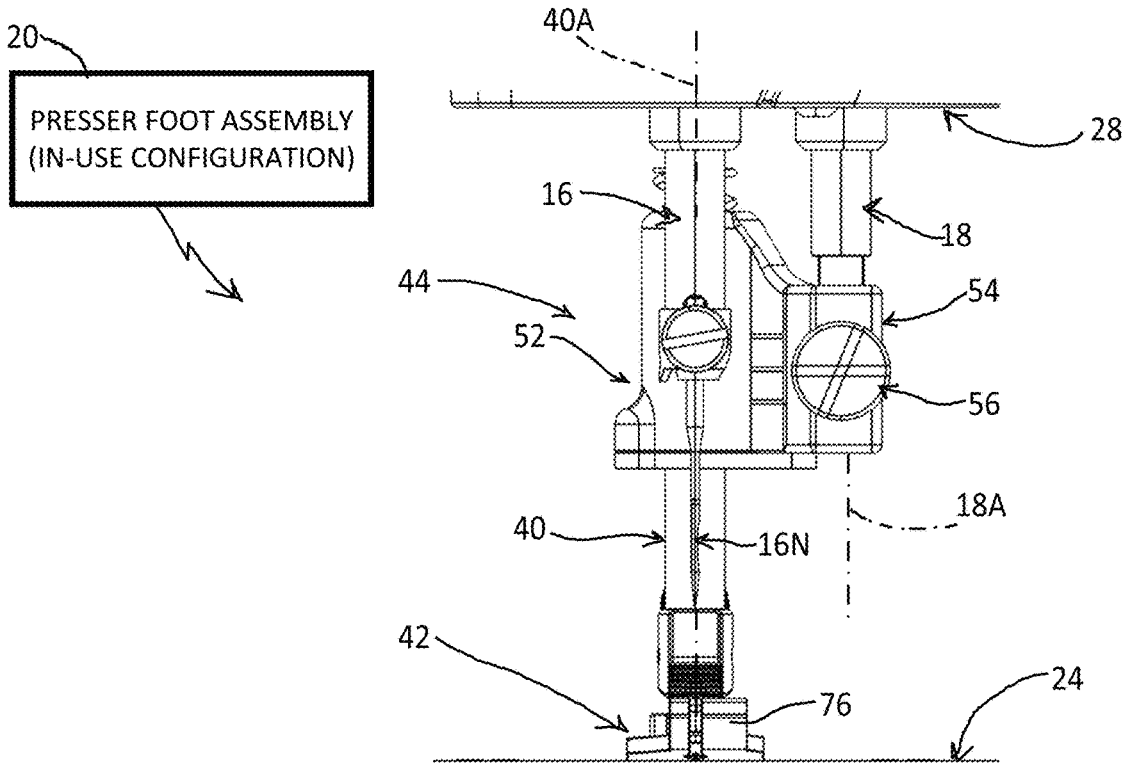
FIG. 5 is a front view of the sewing machine assembly of FIG. 1 showing the mount arm of the auxiliary presser bar mount is angled relative to the mount body so that the auxiliary axis of the auxiliary presser bar is offset from the main axis of the main presser bar while being in line with the needle bar axis.
Figure 6:
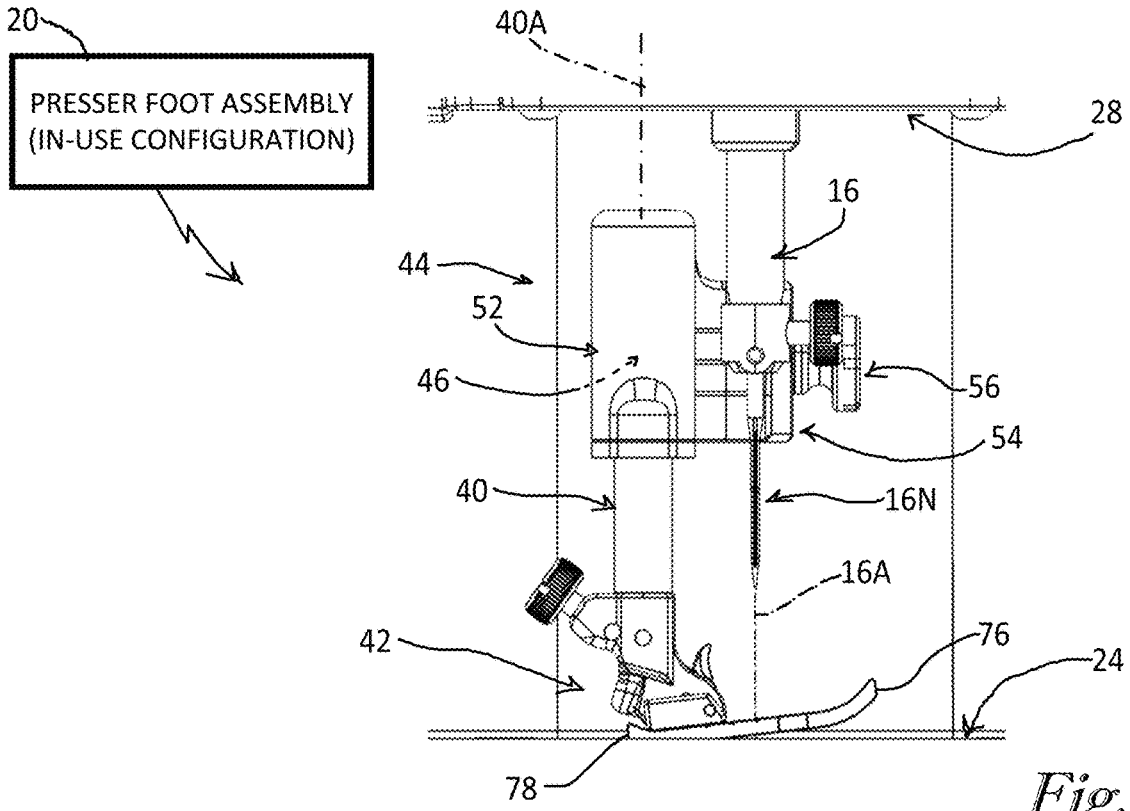
FIG. 6 is an elevation view of the sewing machine assembly of FIG. 1 showing the mount arm of the auxiliary presser bar mount is angled relative to the mount body so that the auxiliary axis of the auxiliary presser bar is offset from the main axis of the main presser bar.

The mount body 52 includes a housing member 62 and a cover plate 64 as shown in FIGS. 3 and 4. The housing member 62 is formed to define the presser bar hole 58. The cover plate 64 is coupled to the housing member 62 to close a portion of the opening to the presser bar hole 58. The cover plate 64 has a through hole 64H that receives the auxiliary presser bar 40. Fasteners 66 extend through the cover plate 64 into the housing member 62 to couple the cover plate 64 to the housing member 62 in the illustrative embodiment.

Figure 7:
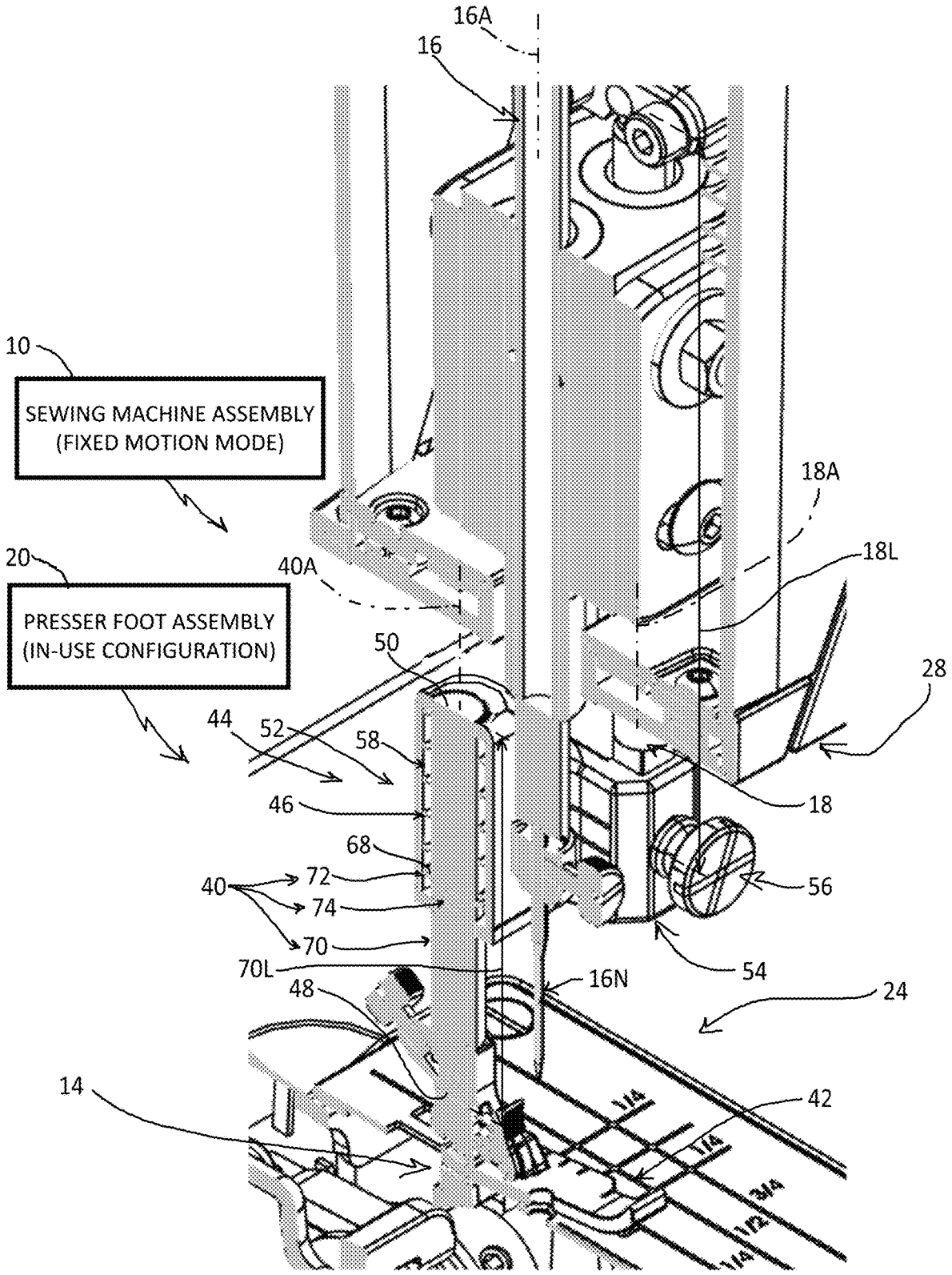
FIG. 7 is a cross-section view of the sewing machine assembly of FIG. 1 showing the bias element is arranged in the presser bar hole of the mount body so that the bias element extends around the auxiliary presser bar.

The auxiliary presser bar 40 is formed to define a shoulder surface 68 as shown in FIGS. 4 and 7. The bias element 46 engages the shoulder surface 68 to apply the bias force to the auxiliary presser bar 40.

In the illustrative embodiment, the auxiliary presser bar 40 includes a rod 70 with a lip 72 as shown in FIGS. 4 and 7. The rod 70 extends along the auxiliary axis 40A. The lip 72 extends circumferentially around the rod 70 and radially outward from the rod 70 to define the shoulder surface 68. The bias element 46 extends around the rod 70 and engages the shoulder surface 68 defined by the lip 72 to apply the bias force to the auxiliary presser bar 40.

In some embodiments, the rod 70 and the lip 72 are a single integral component. In the illustrative embodiment, the lip 72 is a washer 72 coupled to the rod 70. The washer 72 is arranged around the rod 70 and a peg 74 extends through the rod 70 to couple the washer 72 to the rod 70. The peg 74 blocks the movement of the washer 72 relative to the rod 70.

In the illustrative embodiment, the main presser bar 18 has a first axial length 18L and the rod 70 of the auxiliary presser bar 40 has a second axial length 70L as shown in FIGS. 4 and 7. The second axial length 70L of the auxiliary presser bar 40 is less than the axial length 18L of the main presser bar 18.

The presser foot 42 has a lead edge 76 and a trailing edge 78 as shown in FIGS. 3 and 4. The trailing edge 78 is spaced apart horizontally from the lead edge 76. The presser foot 42 is aligned with the feed dog 30. The presser foot 42 may also be configured to be selectively coupled to the first end 48 of the auxiliary presser bar 40 as shown in FIG. 4.

In the free motion mode, a hopping foot may be selectively coupled to the main presser bar 18. However, in the fixed motion mode, the presser foot assembly 20 is coupled to the main presser bar 18.

A method of using the sewing machine assembly 10 may include several steps. The method may begin with the sewing machine assembly 10 in one of the free motion mode and the fixed motion mode. The user may desire to switch the sewing machine assembly 10 to the other mode.

To switch the sewing machine assembly 10 from the fixed motion mode to the free motion mode, the user begins by changing the presser foot assembly 20 from the in-use configuration to the unused configuration as shown in FIG. 9. To change the presser foot assembly 20 from the in-use configuration to the unused configuration, the user removes the fastener 56 from the auxiliary presser bar mount 44 and the main presser bar 18 so that the presser foot assembly 20 is free to move away from the main presser bar 18. The user then spaces the presser foot assembly 20 away from the main presser bar 18.

After the presser foot assembly 20 is in the unused configuration, the user may change the hopping foot 22 from the unused configuration to the in-use configuration as shown in FIG. 9. The user may use the fastener 56 to couple the hopping foot 22 to the main presser bar 18. Additionally, a feed dog cover 32 may be placed over the feed dog 30 to cover the feed dog 30 as show in FIG. 9.

To switch the sewing machine assembly 10 from the free motion mode to the fixed motion mode, the steps are repeated in reverse. The user may remove the feed dog cover 32 and move the hopping foot 22 to the unused configuration so that the presser foot assembly 20 may be coupled to the main presser bar 18.

In some embodiments, instead of changing the presser foot assembly 20 from the unused and the in-use configurations, the user may uncouple the presser foot 42 from the first end 48 of the auxiliary presser bar 40 and couple the hopping foot 22 to the first end 48 of the auxiliary presser bar 40. The feed dog cover 32 would be placed over the feed dog 30 if the hopping foot 22 is coupled to the auxiliary presser bar 40.

Another embodiment of a sewing machine assembly 210 in accordance with the present disclosure is shown in FIGS. 10-15. The sewing machine assembly 210 is substantially similar to the sewing machine assembly 10 shown in FIGS. 1-9 and described herein. Accordingly, similar reference numbers in the 200 series indicate features that are common between the sewing machine assembly 10 and the sewing machine assembly 210. The description of the sewing machine assembly 10 is incorporated by reference to apply to the sewing machine assembly 210, except in instances when it conflicts with the specific description and the drawings of the sewing machine assembly 210.

The sewing machine assembly 210 has a sewing machine frame 212, a feed dog assembly (not shown), a needle bar 216, a main presser bar 218, and a presser foot assembly 220 as shown in FIGS. 10-15. The sewing machine frame 212 includes a frame base 224, a frame body 226, and the frame head 228. The needle bar 216 is attached to the frame head 228 of the sewing machine frame 212 and configured to linearly reciprocate relative to the frame head 228 along a needle bar axis 216A. A needle 216N is coupled to the needle bar 216. The main presser bar 218 is attached to the frame head 228 of the sewing machine frame 212 and extends toward a frame base 224 along a main axis 218A.

Unlike the presser foot assembly 20 in FIGS. 1-9, the presser foot assembly 220 is mounted directly to the frame head 228 of the sewing machine assembly 210. The presser foot assembly 220 is not able to be changed between the unused configuration and the in-use configuration. Rather, the presser foot assembly 220 remains coupled to the frame head 228.

The presser foot assembly 220 includes an auxiliary presser bar 240, a presser foot 242, and an auxiliary presser bar mount 244 as shown in FIGS. 11-15. The auxiliary presser bar 240 extends along an auxiliary axis 240A. The presser foot 242 is coupled to one end of the auxiliary presser bar 260. The other end is coupled to the frame head 228. In the illustrative embodiment, the auxiliary presser bar mount 244 directly mounts the auxiliary presser bar 240 to the frame head 228 and not the main presser bar 218.

The auxiliary presser bar 240 is offset from the main presser bar 218 to align the presser foot 242 with the feed dog in the frame base 224. The auxiliary axis 240A is offset from the main axis 218A so that the presser foot 262 is aligned with the feed dog while the sewing machine assembly 210.

Figure 12:
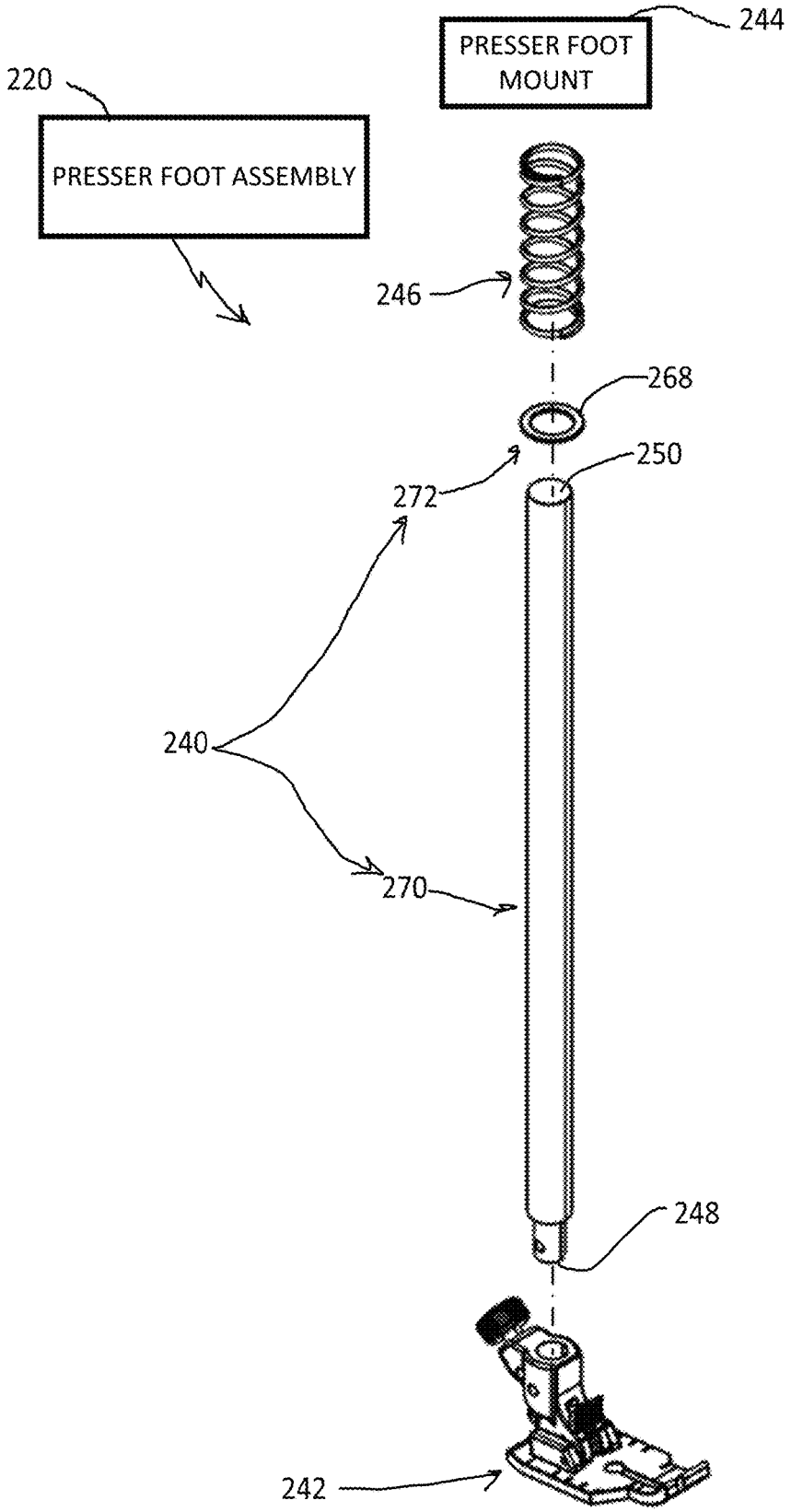
FIG. 12 is an exploded view of the presser foot assembly included in the sewing machine assembly of FIG. 11 showing the presser foot assembly includes an auxiliary presser bar that extends along an auxiliary axis, a presser foot coupled to a first end of the auxiliary presser bar, an auxiliary presser bar mount located in the frame head of the sewing machine frame and configured to be coupled to a second end of the auxiliary presser bar so as to couple the presser foot assembly to the sewing machine frame, and a bias element configured to be arranged to extend around the auxiliary presser bar to apply a bias force to the auxiliary presser bar.
Figure 13:
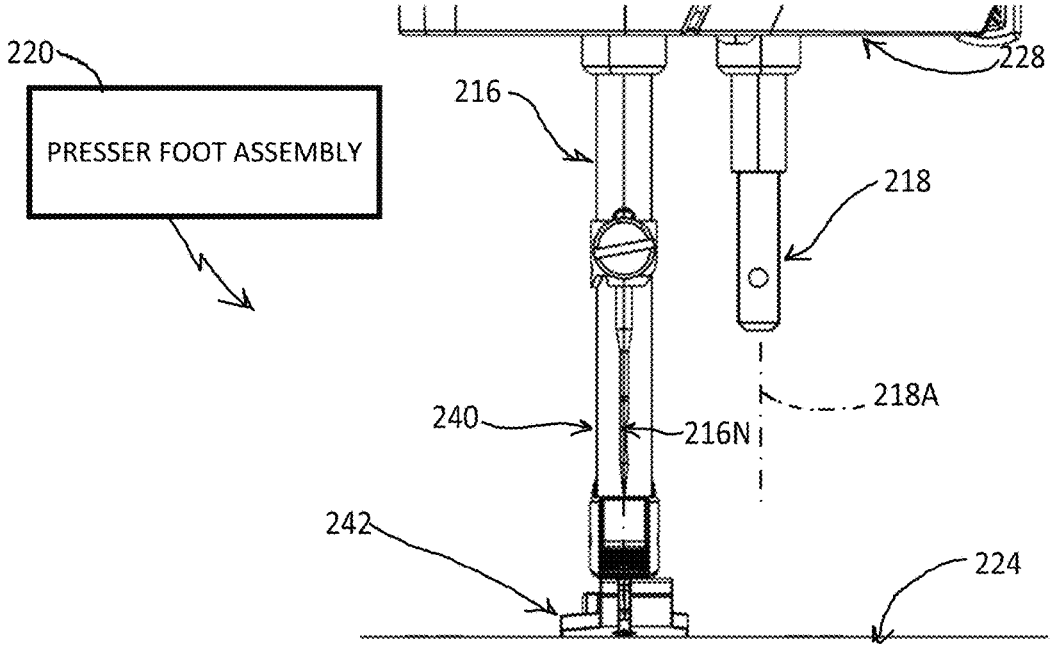
FIG. 13 is a front view of the sewing machine assembly of FIG. 10 showing the auxiliary presser bar is coupled directly to the frame head of the sewing machine frame so that the auxiliary axis of the auxiliary presser bar is offset from the main axis of the main presser bar while being in line with the needle bar axis.
Figure 14:
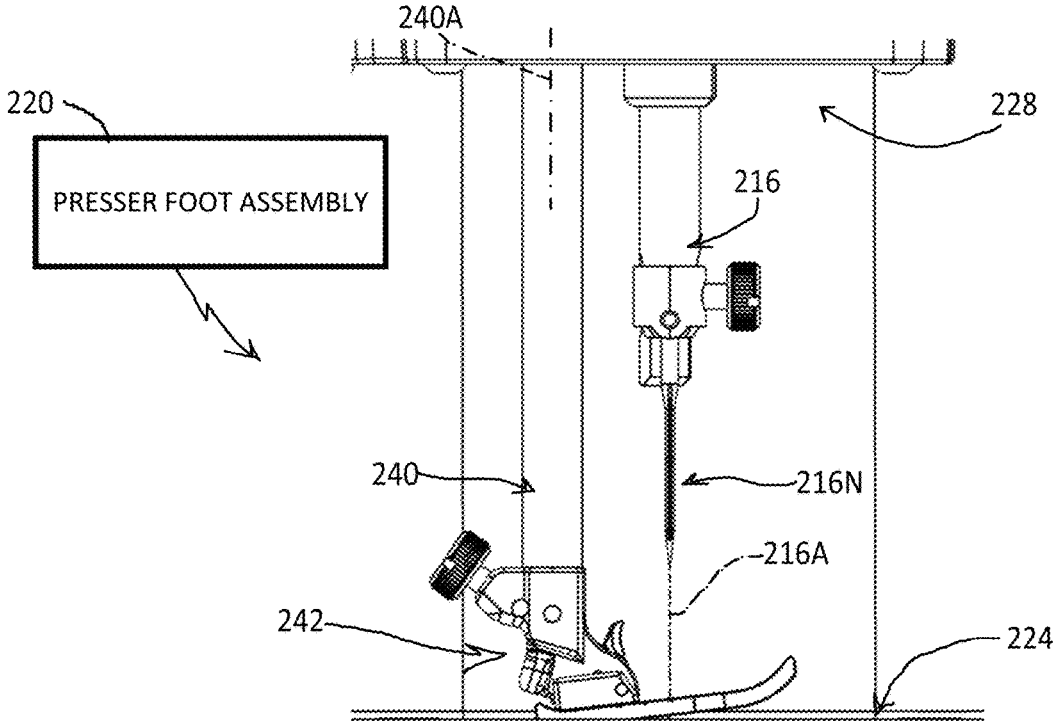
FIG. 14 is an elevation view of the sewing machine assembly of FIG. 10 showing the auxiliary presser bar is coupled directly to the frame head of the sewing machine frame so that the auxiliary axis of the auxiliary presser bar is offset from the main axis of the main presser bar.
Figure 15:
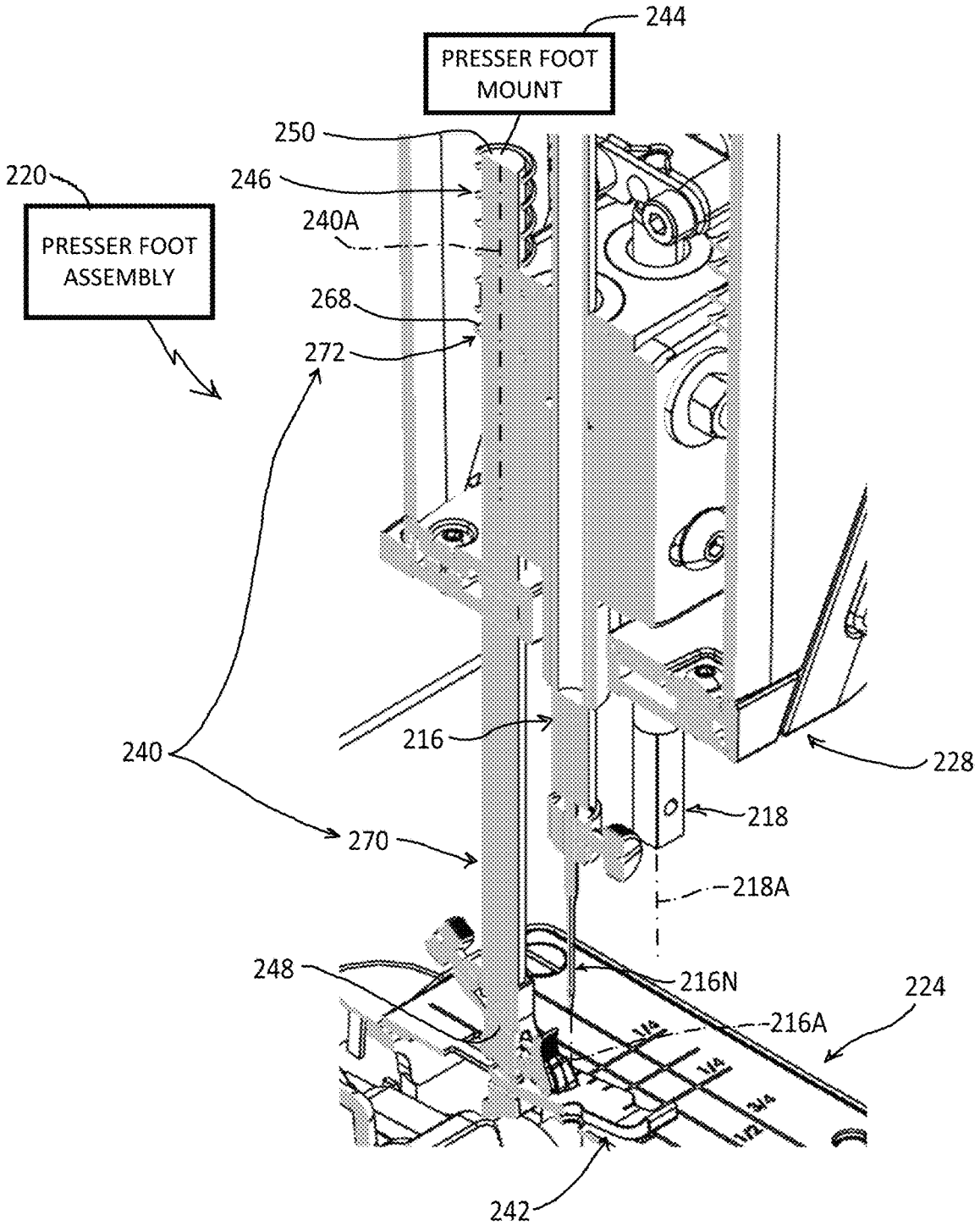
FIG. 15 is a cross-section view of the sewing machine assembly of FIG. 1 showing the bias element is arranged around the auxiliary presser bar within the frame head of the sewing machine frame.

The presser foot assembly 220 further includes a bias element 246 as shown in FIGS. 12 and 15. The bias element 246 is arranged to extend between the frame head 228 and the auxiliary presser bar 240 to apply a bias force to the auxiliary presser bar 240 to urge the presser foot 242 toward the frame base 224 of the sewing machine frame 212. The auxiliary presser bar 240 extends along an auxiliary axis 240A between a first end 248 and a second end 250 spaced apart axially from the first end 248. The presser foot 242 is coupled to the first end 248 of the auxiliary presser bar 240. The auxiliary presser bar mount 244 is coupled to the second end 250 of the auxiliary presser bar 240.

The auxiliary presser bar 240 is formed to define a shoulder surface 268 as shown in FIGS. 12 and 15. The bias element 246 engages the shoulder surface 268 to apply the bias force to the auxiliary presser bar 240.

In the illustrative embodiment, the auxiliary presser bar 240 includes a rod 270 with a lip 272 as shown in FIGS. 12 and 15. The rod 270 extends along the auxiliary axis 240A. The lip 272 extends circumferentially around the rod 270 and radially outward from the rod 270 to define the shoulder surface 268. The bias element 246 extends around the rod 270 and engages the shoulder surface 268 defined by the lip 272 to apply the bias force to the auxiliary presser bar 240.

In some embodiments, the rod 270 and the lip 272 are a single integral component. In the illustrative embodiment, the lip 272 is a washer 272 coupled to the rod 270. The washer 272 is arranged around the rod 270 and coupled to the rod 270.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A sewing machine assembly comprising:

a sewing machine frame including a frame base, a frame body that extends from the frame base, a frame head coupled to the frame body that extends from the frame body toward the frame base to define a throat of the sewing machine frame;

a feed dog assembly including a feed dog mounted to the sewing machine frame to reciprocate horizontally relative to the sewing machine frame;

a main presser bar mounted to the frame head that extends along a main axis from the frame head toward the frame base; and a presser foot assembly configured to be changed between an unused configuration associated with a free motion mode of the sewing machine assembly in which the presser foot assembly is spaced apart from the main presser bar and an in-use configuration associated with a fixed motion mode of the sewing machine assembly in which the presser foot assembly is coupled to the main presser bar, the presser foot assembly including:

an auxiliary presser bar that extends along an auxiliary axis between a first end and a second end spaced apart axially from the first end, a presser foot coupled to the first end of the auxiliary presser bar, an auxiliary presser bar mount coupled to the second end of the auxiliary presser bar and configured to be selectively coupled to the main presser bar to couple the presser foot assembly to the main presser bar in the in-use configuration so that the auxiliary axis of the auxiliary presser bar is offset laterally and longitudinally from the main axis of the main presser bar to align the presser foot with the feed dog on the frame base.

2. The sewing machine assembly of claim 1, wherein the auxiliary presser bar mount includes:

a mount body that defines a presser bar hole configured to receive the second end of the auxiliary presser bar; and a mount arm that extends from the mount body toward the main presser bar at an angle relative to the mount body and defines a presser bar groove configured to receive a terminal end of the main presser bar.

3. The sewing machine assembly of claim 2, wherein the angle of the mount arm relative to the mount body is about 90 degrees.

4. The sewing machine assembly of claim 2, wherein the auxiliary presser bar mount further includes:

a fastener that extends into the mount arm and the main presser bar to couple the presser foot assembly to the main presser bar.

5. The sewing machine assembly of claim 2, wherein the presser foot assembly further includes a bias element arranged in the presser bar hole to extend between the mount body of the auxiliary presser bar mount and the second end of the auxiliary presser bar to apply a bias force to the auxiliary presser bar to urge the presser foot toward the frame base of the sewing machine frame.

6. The sewing machine assembly of claim 1, wherein the presser foot assembly further includes a bias element arranged to extend between the auxiliary presser bar mount and the auxiliary presser bar to apply a bias force to the auxiliary presser bar to urge the presser foot toward the frame base of the sewing machine frame.

7. The sewing machine assembly of claim 6, wherein the auxiliary presser bar includes:

a rod that extends along the auxiliary axis; and a lip that extends radially outward from the rod around the rod, wherein the bias element extends around the rod and engages the lip to apply the bias force to the auxiliary presser bar.

8. The sewing machine assembly of claim 1, wherein the main presser bar has a first axial length and the auxiliary presser bar has a second axial length that is less than the axial length of the main presser bar.

9. The sewing machine assembly of claim 1, further comprising a hopping foot configured to be selectively coupled to a terminal end of the main presser bar in an in-use position when the presser bar assembly is in the unused configuration so that the sewing machine assembly is in the free motion mode.

10. A sewing machine assembly comprising:

a sewing machine frame including a frame base, a frame body that extends from the frame base, a frame head coupled to the frame body that extends from the frame body toward the frame base to define a throat of the sewing machine frame;

a main presser bar mounted to the frame head of the sewing machine frame that extends vertically along a main axis from the frame head toward the frame base and configured to selectively couple to a hopping foot when the sewing machine assembly is in a free motion mode; and an auxiliary presser bar mounted to the frame head of the sewing machine frame that extends vertically along an auxiliary axis that is parallel to the main axis and configured selectively couple to a presser foot when the sewing machine assembly is in a fixed motion mode, wherein the auxiliary axis is laterally and longitudinally offset from the main axis.

11. The sewing machine assembly of claim 10, wherein the auxiliary presser bar is configured to be selectively coupled to the main presser bar to mount the auxiliary presser bar to the frame head.

12. The sewing machine assembly of claim 11, further comprising an auxiliary presser bar mount configured to selectively couple the auxiliary presser bar to the main presser bar, the auxiliary presser bar mount including:

a mount body that defines a presser bar hole configured to receive one end of the auxiliary presser bar;

a mount arm that extends from the mount body toward the main presser bar at an angle relative to the mount body and defines a presser bar groove configured to receive a terminal end of the main presser bar;

a fastener that extends into the mount arm and the main presser bar to selectively couple the auxiliary presser bar to the main presser bar.

13. The sewing machine assembly of claim 12, further comprising a bias element arranged in the presser bar hole to extend between the mount body of the auxiliary presser bar mount and the second end of the auxiliary presser bar to apply a bias force to the auxiliary presser bar to urge the presser foot toward the frame base of the sewing machine frame.

14. The sewing machine assembly of claim 11, wherein the auxiliary presser bar is mounted directly to the frame head of the sewing machine frame.

15. The sewing machine assembly of claim 14, further comprising a bias element arranged to extend between the frame head and the auxiliary presser bar to apply a bias force to the auxiliary presser bar to urge the presser foot toward the frame base of the sewing machine frame.

16. The sewing machine assembly of claim 15, wherein the auxiliary presser bar includes:

a rod that extends along the auxiliary axis; and a lip that extends radially outward from the rod around the rod, wherein the bias element extends around the rod and engages the lip to apply the bias force to the auxiliary presser bar.

17. The sewing machine assembly of claim 1, further comprising a bias element arranged to apply a bias force to the auxiliary presser bar to urge the presser foot toward the frame base of the sewing machine frame.

18. A sewing machine assembly comprising:

a sewing machine frame including a frame base, a frame body that extends from the frame base, a frame head coupled to the frame body that extends from the frame body toward the frame base to define a throat of the sewing machine frame;

a feed dog assembly including a feed dog mounted to the sewing machine frame to reciprocate horizontally relative to the sewing machine frame;

a main presser bar mounted to the frame head that extends along a main axis from the frame head toward the frame base; and a presser foot assembly configured to be changed between an unused configuration associated with a free motion mode of the sewing machine assembly in which the presser foot assembly is spaced apart from the main presser bar and an in-use configuration associated with a fixed motion mode of the sewing machine assembly in which the presser foot assembly is coupled to the main presser bar, the presser foot assembly including:

an auxiliary presser bar that extends along an auxiliary axis between a first end and a second end spaced apart axially from the first end, a presser foot coupled to the first end of the auxiliary presser bar, an auxiliary presser bar mount coupled to the second end of the auxiliary presser bar and configured to be selectively mounted to the frame head of the sewing machine frame to couple the presser foot assembly to the sewing machine frame in the in-use configuration so that the auxiliary axis of the auxiliary presser bar is laterally and longitudinally offset from the main axis of the main presser bar to align the presser foot with the feed dog on the frame base.

* * * * *